United States Patent [19]

Krause

[11] 4,112,824

[45] Sep. 12, 1978

[54] DOUBLE-HYDRAULIC ACTUATOR

[75] Inventor: Alois Krause, Neubiberg, Germany

[73] Assignee: Messerschmitt-Bolkow-Blohm Gesellschaft mit Beschrankter Haftung, Munich, Germany

[21] Appl. No.: 807,184

[22] Filed: Jun. 16, 1977

Related U.S. Application Data

[63] Continuation of Ser. No. 621,389, Oct. 10, 1975, abandoned.

[30] Foreign Application Priority Data

Oct. 23, 1974 [DE] Fed. Rep. of Germany ..... 2450330

[51] Int. Cl.[2] ..... F15B 11/16

[52] U.S. Cl. ..... 91/413; 91/448; 137/596.12; 137/637.1

[58] Field of Search ..... 91/411 A, 413, 414, 91/32, 437, 446, 448, 363 A, 384; 137/637.1, 596.12, 596

[56] References Cited

U.S. PATENT DOCUMENTS

| | | | |
|---|---|---|---|
| 3,253,613 | 5/1966 | Richolt | 137/596 |
| 3,527,143 | 9/1970 | Hayter | 91/411 A |
| 3,529,514 | 9/1970 | Mayo | 91/411 A |
| 3,878,764 | 4/1975 | Zech | 91/411 R |
| 3,933,176 | 1/1976 | Wheeler | 137/596 |

*Primary Examiner*—Martin P. Schwadron
*Assistant Examiner*—Abraham Hershkovitz
*Attorney, Agent, or Firm*—Blanchard, Flynn, Thiel, Boutell & Tanis

[57] ABSTRACT

Control means for a double-hydraulic actuator. In a hydraulic actuator having at least two mechanically coupled servomotors, there is provided valve means for at least one of said motors wherein an internal spool valve is surrounded by a sleeve valve which in turn is itself surrounded by an outer sleeve, the sleeve valve constituting a sleeve surrounding and operable with respect to the spool valve and said sleeve valve itself constituting an axially movable valve with respect to said outer sleeve and force limiting means connecting said spool to said sleeve valve in such a manner that in normal operation same will move as a single unit but upon interference with movement between said sleeve valve and said sleeve, force applied to the spool valve will override said force limiting means and effect relative motion between said spool valve and said sleeve valve.

3 Claims, 5 Drawing Figures

DOUBLE-HYDRAULIC ACTUATOR

This is a continuation of application Ser. No. 621,389 filed Oct. 10, 1975, now abandoned.

FIELD OF THE INVENTION

The invention relates to a double-hydraulic actuator having at least two mechanically coupled servomotors, in which are also mechanically coupled the piston rods of the control valves associated with a changeover device, or members which transmit control signals to the piston rods, particularly wherein the changeover device selectively renders either one or the other servomotor hydraulically active.

BACKGROUND OF THE INVENTION

In such a known servo drive (U.S. Pat. No. 3,878,764), in which of two servomotors only one operates on a common output and the other one at such time follows pressureless in standby condition, a positive, but force limiting, connection is provided between each control valve piston rod and the member which relays control signals to it. This connection permits in case of malfunctioning of one control valve sleeve valve an "overriding" of same and the second and presumably operative control valve sleeve valve (of the second servomotor) can still be moved by means of the member which transmits the relevant control signals. The changeover device is advantageously in active engagement with the connection which exists between the control valve piston rod of the (first) servomotor, which serves as a main drive, and the member, which relays control signals to this piston rod so that a blocking of the sleeve valve in the control valve of the first servomotor effects an automatic switching over to the second and presumably operative servomotor or it control valve.

In this double-hydraulic actuator, the members which relay the control signals are, for example, levers which are coupled through a rod which is hinged thereon, and are pivotally hinged to the operating piston rod of the respectively associated servomotor. The positive but force limiting connection between each lever and the associated control valve piston rod, thus permits a further pivoting of the lever when the sleeve valve of the respective control valve blocks. Thus a blocked control valve sleeve valve does not result in a blocking of the entire linkage. Only control forces — exceeding the normal control forces — must be produced for the further pivoting of the levers or the "overriding" of the blocked control valve sleeve valve. An "overriding" due to an overloading of the positive connection can, however, occur also when same is loaded in pressureless condition of the actuator through adjustment of the linkage or pivoting of the levers, for example during servicing of the system which is connected to the actuator. The operating piston rods of the actuator are often in this case moved directly through the linkage of the levers, in order to effect a control in the connected system. For this purpose, positive control forces must be produced, which considerably exceed the normal control forces of a hydraulically active actuator. The consequence is an undesired frequent stress and thus a wear of the connections which inevitably eventually creates damage. The latter is particularly true for members which are in direct active engagement with the positive connections, like microswitches and the like. Furthermore, there exists also a problem in the controlling of the "overridability" of the sleeve valves at a pressureless actuator. If such an "overriding" is by mistake and not corrected, it can lead to serious consequences during operation.

SUMMARY OF THE INVENTION

The basic purpose of the invention is to provide an actuator of the above-mentioned type, with respect to the blocking of a control valve or its sleeve valve, without positive control-force-limiting connections, between the control valve piston rods and the members relaying control signals to them.

This purpose is attained by providing for each control valve a sleeve valve which is axially movable within a control sleeve and is itself a sleeve for at least one slide or spool valve axially movable therein and by further providing a positive but force limiting connection between the inner slide valve and the sleeve valve.

Thus in the actuator according to the invention the positive connections, which each permit an "overriding" of a blocked sleeve valve, are integrated into the respective control valve in such a manner that only during one blocking of the sleeve valve the associated positive connection becomes active as a force limiting connection. Only during blocking is the inner control slide, or spool, valve moved relative to the sleeve valve. In all remaining cases of a force action on the control valve piston rod, the sleeve valve is shifted by the inner control slide or spool valve relative to the control sleeve, namely the positive connection must perform only its connecting function between said valves and can thereby in no manner be overloaded.

A further important advantage of the actuator according to the invention lies in same requiring only two shut-off members compared with the known actuator with respect to maintaining the capability to function during blocking of a control valve and thus does not only require less input, but will also be less susceptible to trouble. If for example the changeover device, as in the known actuator, consists substantially of one switching element in the form of a differential cylinder, which is loaded on the piston side by the supply pressure of a first servomotor and on the piston rod side (annular chamber) by the supply pressure of a second servomotor, it will also be provided that the piston rod of the differential cylinder actively engages a shut-off member which, depending on the piston position, closes or opens the pressure medium intake to the second servomotor, and which shut-off member is coupled to a second shut-off member which opens or closes the pressure medium intake to the first servomotor. However, the pressure medium intake to the piston side of the differential cylinder can occur directly from a supply line which is associated with the control valve of the first servomotor. This measure requires only that during shifting of the inner control slide valve relative to the outer sleeve valve, in the control valve of the first servomotor between a pressure medium intake and pressure medium return, there can be created on opening of such a cross section as to effect a pressure medium discharge from the control valve in the direction of at least a supply pressure drop in the control valve and on the piston side of the differential cylinder. This causes an automatic changing over to the second servomotor and the hydraulic activation thereof. With respect to this, however, it is necessary in the known actuator to provide a separate shut-off member between the piston side of the differential cylinder and the pressure source which supplies the first servomotor, in order to effect during blocking of the control valve a supply pressure drop on the piston side of the differential cylinder.

BRIEF DESCRIPTION OF THE DRAWINGS

One exemplary embodiment of the invention and further developments thereof which are characterized in the subclaims will be discussed more in detail hereinafter in connection with the drawings, in which:

DETAILED DESCRIPTION

Figure 1:
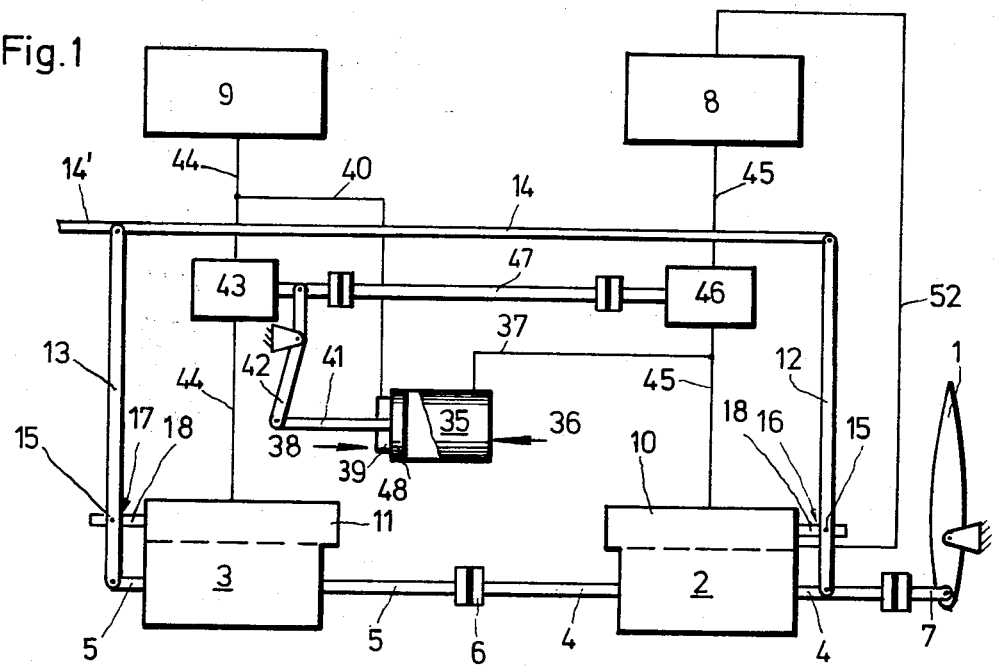
FIG. 1 schematically illustrates a control in which a linkage is provided for transmitting control signals to a double-hydraulic actuator.

A control surface 1, for example an elevator of an aircraft, can be pivoted as illustrated in FIG. 1 by two mechanically coupled servomotors 2 and 3, which are provided for this purpose with operating cylinders having operating piston rods 4 or 5 extending therethrough. Said piston rods are connected axially rigidly by a coupling 6, for example a conventional connecting rod coupling. The piston rods 4 and 5 can be moved radially within limits in order to compensate for angle errors and the like. The servomotors 2 and 3 are so-called "simple" servomotors with equal outputs. They operate on a common output linkage 7 which is coupled between the control surface 1 and the operating piston rod 4 of the servomotor 2, which latter serves as main drive. However, of the servomotors 2 or 3, which are connected to a separate pressure source 8 or 9, only one is constantly hydraulically active, while the second one follows in readiness but without pressure thereon. Thus, the actuator shown in FIG. 1 is not a so-called "true" double hydraulic. This will be discussed more in detail below.

The control valves 10 and 11 of the servomotors 2 or 3 are also mechanically coupled. A linkage is used for this in which, as in a parallel-crank mechanism, two two-arm levers 12 or 13 are connected pivotally by a rod 14 and said levers are each hinged to one of the operating piston rods 4 and 5. The rod 14 can be adjusted for example by a control stick (not illustrated), which acts onto its free end 14'. Each lever 12 and 13 has a cap screw 15, which is movably arranged in an elongated slot 15' of the associated control valve piston rod 16 or 17 or a coupling part 18 of the same. The coupling parts 18 are thereby guided through the associated lever 12 or 13, which for this purpose has in the zone of its axis of rotation an opening 19, same being illustrated in FIG. 2 only for the rightward lever 12. With respect to the rod 14, it may be further mentioned that it can, for obtaining an easier adjustment of the levers 12 and 13 which are coupled with one another by it, be equipped additionally with usual screw locks or the like.

Figure 2:
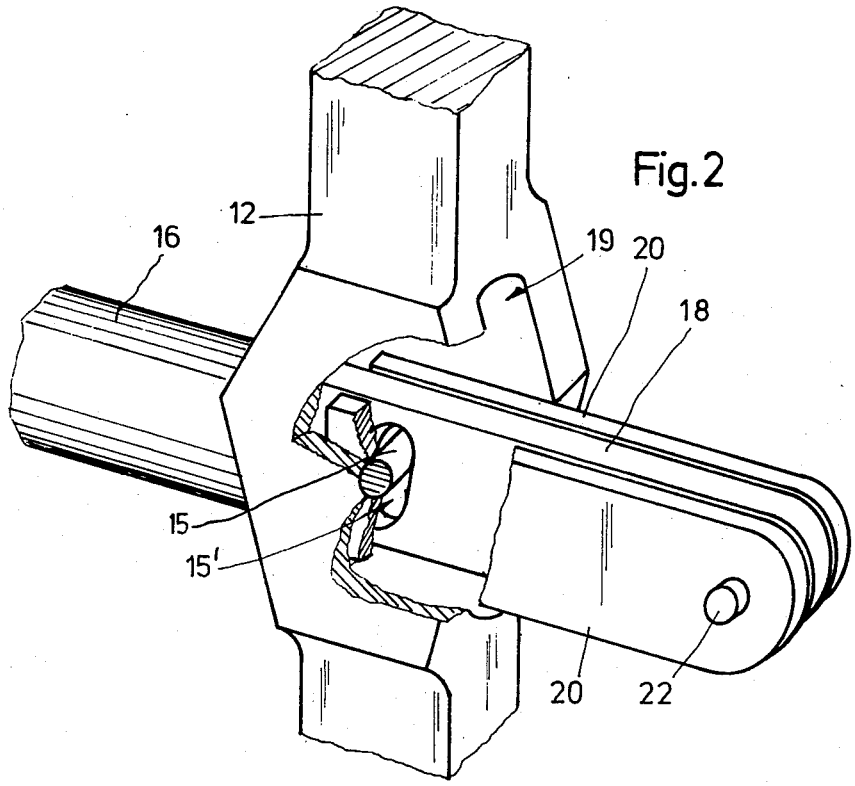
FIG. 2 is a perspective view, partly broken open, of details of the connection between a control valve piston rod and a member of the linkage according to FIG. 1.
Figure 3:
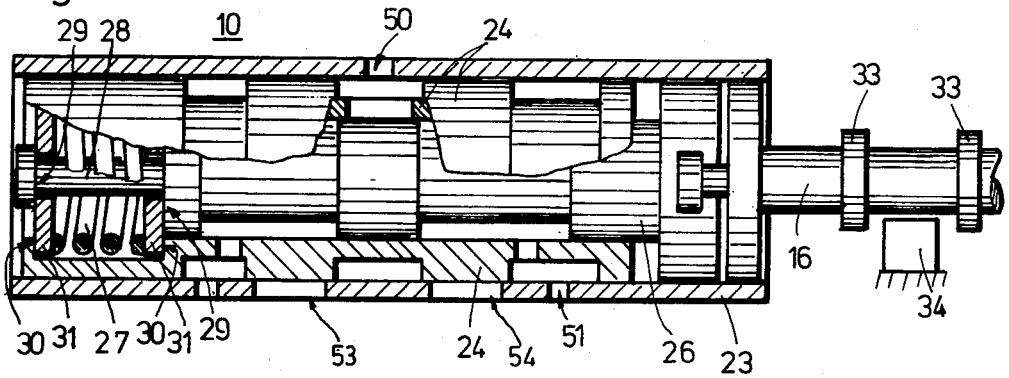
FIG. 3 illustrates a control valve in rest position, wherein its sleeve valve is illustrated only partly cut, together with a partly visible central section of a slide valve.

Details of the connections for transmitting of control forces between the levers 12, 13 and the associated control valve piston rod 16 or 17 are illustrated also in FIG. 2 only for the control valve piston rod 16 of the main servomotor 2, because these connections are constructed the same for both servomotors. The afore-mentioned cap screw 15 is a pivotal connector for two plates 20 which extend on both sides of the coupling part 18 and which can be pivoted at their outer ends about a second pivotal connector 22 which is arranged in the coupling part. Through such a connection, which is rigid only in axial direction of the respective control valve piston rod 16 and 17, the piston rod is moved axially during pivoting of the associated lever 12 or 13. However, further measures are needed in order to exclude during a blocking of a control valve 10 or 11 or its sleeve valve a blocking of the entire linkage. For this purpose in each control valve 10 (FIGS. 3, 4) and 11 (FIG. 5) there is provided a sleeve valve 24 which is axially movable in a control sleeve 23 and is itself a sleeve for a (auxiliary) slide or spool valve 26 or 26', with which the control valve piston rod 16 or 17 is coupled. The coupling between the inner slide valve 26 or 26' and the sleeve valve 24 is provided by a helical spring 27 which is arranged therein, and which is supported in both control directions on one end by the slide valve and on the other end by the sleeve valve. For this purpose, the helical spring 27 is arranged around a tappet 28 which is provided at the end of the slide valve 26 or 26' and is inserted both between stops 29 — which limit the tappet — and also between stops 30 of the outer sleeve valve 24. For this purpose, the helical spring 27 can be supported at both ends on the usual washers 31.

The afore-described positive but force limiting connection between the sleeve valve 24 and the slide valve 26 or 26' provides that the latter, for example during a blocking of the sleeve valve by a chip 32 or the like (FIG. 4), can be moved relative to the sleeve valve. From this it follows that during a blocking of a sleeve valve 24 of the control valves 10 and 11 the linkage remains adjustable and the levers 12 and 13 can still be pivoted. The helical spring 27 of the respective blocked control valve (for example FIG. 4), which helical spring acts against the respective control forces, effects then an axial movement of the slide valve through the control valve piston rod 16 which is hinged thereto, namely in each control direction. Of course, this movement will only be possible upon exceeding the normal control forces and only the helical spring 27 of the blocked sleeve valve 24 (for example FIG. 4) will become effective. Thus, with the afore-described construction of the control valves 10 and 11 it is required only that greater control forces be produced in the case of a blocking of a sleeve valve 24 in order to "override" same. The connection (helical spring 27) in the respective control valve 10 and 11 is thereby integrated such that it becomes active as a force limiting connection only upon a blocking of the sleeve valve 24 — simulated possibly also by means of a special device. In this connection, it is noted that the stops 33 which appear in FIGS. 3 to 5 on the control valve piston rod 16 or 17 in connection with a stationary stop 34 are provided in the usual manner for stroke limiting, protective, purposes.

In order to effect, during a blocking of the control valve 10 of the main servomotor 2, an automatic switching over to the second (auxiliary) servomotor 3 or its control valve 11 in the manner that the latter becomes hydraulically active and the malfunctioning main servomotor becomes hydraulically passive or pressureless, there is provided as shown in FIG. 1, a differential cylinder 35. Same is pressurized on the piston side 36 through a line 37 by the supply pressure of the main servomotor 2 and on the piston rod side 38 (annular chamber 98) through a line 40 by the supply pressure of the auxiliary servomotor 3. The piston rod 41 of the differential cylinder 35 is thereby in active engagement with a shut-off member 43 through a bent lever 42, which shut-off member 43 is connected to a line 44 connecting the auxiliary servomotor 3 to its pressure source 9. It can be seen that this shut-off member 43 has an influence on the loading of the annular chamber 39 with the supply pressure of the last-mentioned servomotor 3. Finally a shut-off member 46 is connected into a line 45, which connects the control valve 10 of the main servomotor 2 to its pressure source 8, which shut-off valve is coupled to the first shut-off member 43 through a linkage 47.

Of the two mechanically coupled shut-off members 43 and 46, for example sleeve valves, only one is always open, while the other one blocks. If for example the second shut-off member 46 is open and the main servomotor 2 therefore hydraulically active, then the pressure medium supply line to the auxiliary servomotor 3 or to its control valve 11 is blocked through the first shut-off member 43. At the same time the line 37 causes the piston 48 of the differential cylinder 35 to be loaded by the supply pressure of the main servomotor 2 and same is thus in a clear limit position. The piston 48 is in the extended position illustrated in FIG. 1. At equally large supply pressures, the force (line 37), which is applied on its larger piston surface by the supply pressure of the main servomotor 2, is namely substantially greater than the force (line 40), which is applied on its smaller annular surface by the supply pressure of the auxiliary servomotor 3. In this condition the piston 48 of the differential cylinder 35 also holds closed the first shut-off member 43 through the bent lever 41.

Figure 4:
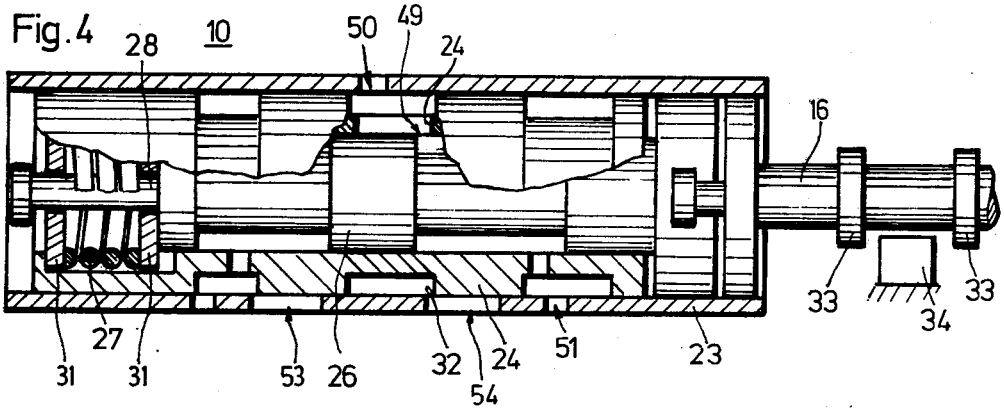
FIG. 4 illustrates the control valve of FIG. 3 with the sleeve valve in an operating position and with the slide valve in a so-called overriding position.
Figure 5:
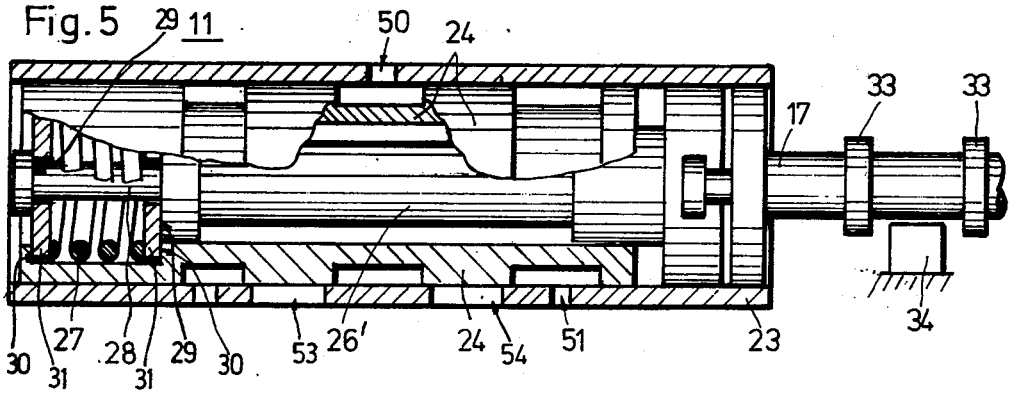
FIG. 5 illustrates a modified control valve, same differing from the control valve shown in FIG. 3 only in the shape of the inner slide valve.

In the case of a blocking of the sleeve valve 24 in the control valve 10 of the main servomotor 2, an opening 49 between a pressure medium intake 50 and pressure medium return 51 of the control sleeve 23 is created, as shown in FIG. 4, due to the shifting of the slide valve 26 which shifting results from the blocking. The (supply) line 45, which is illustrated only in FIG. 1, is connected to the pressure medium intake 50 and a line 52, which is also illustrated only in FIG. 1 and which is used to return the pressure medium into the pressure source 8 of the main servomotor 2, is connected to the pressure medium return 51. The afore-mentioned opening 49 has such a cross section that the pressure medium outlet from the control valve 10 effects at least a supply pressure drop both in the control valve and also on the piston side 36 of the differential cylinder 35. Through this the main servomotor 2 becomes hydraulically passive on one side. On the other side the piston 48 of the differential cylinder 35 is automatically retracted, namely it assumes, due to the now higher supply pressure on the piston rod side 38, the second stop position. Consequently the first shut-off member 43 is opened by the bent lever 42 and simultaneously therewith the second shut-off member 46 is closed by the linkage 47. The auxiliary servomotor 3 is thus hydraulically active, while the main servomotor 2 is pressureless. By closing the second shut-off member 46 the not-illustrated operating piston of the main servomotor 2, the operating cylinder of which is connected on one side to a hole 53 and on the other side to a hole 54 of the control sleeve 23, is prevented from getting into a so-called hard, or loaded, condition.

Accordingly, the auxiliary servomotor 3, the control valve 11 of which (or more specifically, the sleeve valve 24 of which) has at all times the same position as that of the main servomotor 2, takes over automatically the driving function when this control valve 10 is blocked. It is thus possible to prevent blocking of the also not-illustrated operating piston of the auxiliary servomotor 3 which is in operation by the piston of the main servomotor 2 in the usual manner by means of a bypass device (bypass valve), which acts pressure-dependently and creates accordingly at the afore-mentioned supply pressure drop or the supply pressure disconnection a free passage for the pressure medium which exists in the associated operating cylinder between its chambers. The same is valid for the auxiliary servomotor 3, when same is pressureless and the main servomotor 2 is hydraulically active. The control valve 11 of the auxiliary servomotor 3 has, compared with the one according to FIGS. 3 and 4, only the difference that no opening is provided between the pressure medium intake 50 and the pressure medium return 51 and thus the latter is functionless. Thus, the two control valves 10 and 11 differ substantially only in the form of the slide valve 26 or 26'.

Of course, the auxiliary servomotor 3 is also automatically switched hydraulically active upon failure of the supply pressure of the main servomotor 2 for example due to the failure of its energy circuit, because then again the pressure on the greater piston surface of the differential cylinder 35 is missing and the piston 48, which thus transfers into its second (not illustrated) limit position, switches the first shut-off member 43 to open through the piston rod 41 and the bent lever 42.

The described arrangement is naturally not limited to a double hydraulic drive with two "simple" servomotors. In place of these servomotors, motors can also be used, in which three similar operating cylinders are arranged parallel to one another and are provided with a common valve unit. Such actuators (servomotors) are used for example for controlling the rotor blades of rotary-wing aircraft.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a redundant fluid actuator system comprising at least two separate and separably operated servomotors, first and second fluid pressure sources, each of said servomotors having a first piston rod connected to each other and mounted for reciprocal movement and a control valve for controlling the movement of said first piston rods, each of said control valves having a second piston rod thereon, a common control member for controlling both of said servomotors, said common control member including means for mechanically coupling said common control member to at least each of said piston rods, means for preventing the operation of one of said servomotors while permitting an operation of the other of said servomotors, and change-over means for effecting a change-over in operation from one of said servomotors to the other of said servomotors, the improvement comprising wherein each of said control valves has a hollow sleeve member with a first axially extending opening therethrough, said hollow sleeve member having an intake port, a return port and plural outlet ports connected in fluid circuit with a respective one of said servomotors associated therewith, a hollow sleeve valve member having a second axially extending opening therethrough reciprocally mounted in said first opening, a slide valve member reciprocally mounted in said second opening, coupling means for coupling said slide valve member to said second piston rod of the respective one of said control valves associated with said respective one of said servomotors and connecting means for connecting said slide valve member to said hollow sleeve valve member for normal simultaneous movement together, said connecting means having a positive but a force limiting threshold connection characteristic to enable said slide valve member to move relative to said hollow sleeve member when said hollow sleeve valve member fails to move relative to said hollow sleeve member in response to a force applied by said common control member to said second piston rod which is greater than the threshold value of said connecting means;

wherein said change-over means consist of a differential cylinder having a reciprocal piston mounted therein and a rod connected to said piston and movable therewith, and a pair of shut-off valves each connected to fluid circuit between one of said first and second fluid pressure sources and one of said two servomotors for controlling the supply of pressurized fluid to said servomotors, a fluid circuit between said first and second fluid pressure sources and the corresponding one of said servomotors including a conduit, a first fluid connection to one end of said differential cylinder on one side of said piston and to said first fluid pressure source supplying pressurized fluid to one of said servomotors, a second fluid connection to the other end of said differential cylinder on the other side of said piston and connected directly to the one of said conduits extending between one of said shut-off valves and the other of said servomotors, each of said pair of shut-off valves having a control lever and means for connecting said control levers together and to said rod of said differential cylinder for simultaneous operation thereby;

wherein said differential cylinder has chambers of differing effective cross sectional area on opposite sides of said piston, a greater cross sectional area side corresponding to said other end of said differential cylinder and a lesser cross sectional area side corresponding to said one end of said differential cylinder, the pressure of said pressurized fluid from said first and second fluid pressure sources being equal wherein said piston will be urged to said one end of said differential cylinder having said lesser cross sectional area to effect an opening of the fluid pressure supply to said other servomotor while simultaneously shutting off the fluid pressure supply to said one servomotor;

wherein a shifting of the said slide valve member relative to said sleeve valve member effects a fluid connection between said intake port and said return port through an opening of such a cross section as to effect a fluid discharge from said intake port direct to said return port to cause a pressure drop in fluid pressure in said other end of said differential cylinder having the larger cross section and a shifting of said piston to cause a shutting off of said fluid pressure supply to said other servomotor while simultaneously opening the fluid pressure supply to said one servomotor; and said first fluid pressure source being at all times in open fluid communication with said one end of the differential cylinder through said first fluid connection and said other end of the differential cylinder being at all times in open fluid communication with said one of said shut-off valves and the control valve for said other servomotor.

2. The improved actuator according to claim 1, wherein said positive but force limiting threshold connection between said slide valve member and said sleeve valve member includes a spring element arranged in said sleeve valve member with one end engaging said slide valve member and the other end engaging said sleeve valve member.

3. The improved actuator according to claim 2, wherein said spring encircles a tappet connected to one end of said slide valve member and is slidingly received in openings in a pair of spaced stops which limit the movement of the tappet and thereby the relative movement between said slide valve member and said sleeve valve member.

* * * * *